United States Patent [19]

Adlersberg et al.

[11] Patent Number: 5,012,519

[45] Date of Patent: Apr. 30, 1991

[54] NOISE REDUCTION SYSTEM

[75] Inventors: Shabtai Adlersberg, Petah-Tikva; Yoram Stettiner, Ramat-Hasharon; Mendel Aizner, Rishon-Le-Zion; Alberto Berstein, Beer Sheeva, all of Israel

[73] Assignee: The DSP Group, Inc., San Jose, Calif.

[21] Appl. No.: 463,950

[22] Filed: Jan. 5, 1990

Related U.S. Application Data

[63] Continuation of Ser. No. 150,752, Feb. 1, 1988, abandoned.

[30] Foreign Application Priority Data

Dec. 25, 1987 [IL] Israel ..... 84948

[51] Int. Cl.[5] ..... G10L 5/00

[52] U.S. Cl. ..... 381/47; 381/46

[58] Field of Search ..... 381/47, 46

[56] References Cited

U.S. PATENT DOCUMENTS 3,403,224 9/1968 Schroeder .
3,431,355 3/1969 Rothauser et al. .
3,743,787 7/1973 Fujisaki .
3,855,423 12/1974 Brendzel .
3,878,337 4/1975 Fariello .
3,989,897 11/1976 Carver .
4,000,369 12/1976 Paul, Jr. .
4,048,443 9/1977 Crochiere .
4,133,976 1/1979 Atal et al. .
4,227,046 10/1980 Nakajima .
4,227,049 10/1980 Tompson et al. .
4,283,601 8/1981 Nakajima et al. .
4,286,116 8/1981 Sadou .
4,380,824 4/1983 Inoue .
4,538,295 8/1985 Noso .
4,573,188 2/1986 Lewinter .
4,628,529 12/1986 Borth et al. .
4,630,304 12/1986 Borth et al. .

OTHER PUBLICATIONS

IEEE Transactions on Acoustics, Speech, and Signal Processing, vol. ASSP-33, No. 2, Apr. 1985, pp. 443-445, Speech Enhancement Using a Minimum Mean-Square Error Log-Spectral Amplitude Estimator, Y. Ephraim and D. Malah.

IEE Transactions on Acoustics, Speech, and Signal Processing, vol. ASSP-32, No. 6, Dec. 1984, Speech Enhancement Using a Minimum Mean-Square Error Short-Time Spectral Amplitude Estimator, Yariv Ephraim, David Malah.

IEEE Transactions on Acoustics, Speech, and Signal Processing, vol. ASSP-28, No. 2, Apr. 1980, Speech Enhancement Using a Soft-Decision Noise Suppression Filter, Robert J. McAulay, Marilyn L. Malpass.

*Primary Examiner*—Emanuel S. Kemeny

*Attorney, Agent, or Firm*—Townsend and Townsend

[57] ABSTRACT

Noise in a speech-plus-noise input signal is suppressed by splitting the input signal into spectral channels and decreasing the gain in the each channel which has a low signal-to-noise ratio (SNR). A voice operated switch (VOX) acts to detect noise-only input to gate a background noise (input signal) estimator and also to gate a residual noise (output signal) estimator. The gain in each of the channels is controlled by the current value (a posteriori) input signal SNR estimate, modified by the prior value (a priori) input signal SNR estimate, and smoothed as a function of the residual (output noise signal) estimate.

10 Claims, 14 Drawing Sheets

NOISE REDUCTION SYSTEM

This is a Continuation of application Ser. No. 07/150,762, filed Feb. 1, 1988, now abandoned.

FIELD OF THE INVENTION

This invention relates generally to acoustic noise suppression systems and more particularly to an improved digital processing method for detecting and screening noise from speech in real time.

BACKGROUND OF THE INVENTION

Description of the Prior Art

Acoustic noise suppression systems generally serve the purpose of improving overall quality of the desired signal by distinguishing the signal from the ambient background noise.

Earlier noise suppression systems have used spectral substraction techniques and gain modification techniques in an effort to optimize noise suppression. In those approaches, the audio input signal is divided into spectral bands by a bank of bandpass filters, and particular spectral bands are attenuated using gain estimators to reduce their noise energy content.

In most prior art techniques, in order to apply the proper gain factor it is necessary to estimate the energy content of the current background noise present as accurately as possible.

Numerous approaches have been attempted to accurately estimate the current noise but have met limited success. For example, earlier data processing systems appear to have generally used feed forward systems. Those systems have been limited in the accuracy of their noise estimates because they have relied primarily on the energy in current (present-time) signals in order to generate their noise estimates.

Later digital signal processing systems have adopted more sophisticated estimating techniques. For example, a system which utilizes a minimum mean-square error short time spectral amplitude estimator is discussed by Ephraim and Malah. That approach results in a significant reduction in noise and provides enhanced speech with colorless noise. Subsequent work along these lines has produced an error estimation technique that minimizes the mean-square error of the long-spectra.

Those estimators have been found to lower the residual noise level without further affecting the speech itself. However, those estimation techniques in and of themselves have been unable to remove colorless background noise. Moreover, those estimating techniques are essentially mathematical, and the way they are implemented critically affects their effectiveness within a total noise reduction system. Further, those approaches do not appear to rely on previously processed results but essentially rely on current noisy speech signals.

Systems that have used previously processed signal information have generally been unsophisticated and have avoided sophisticated processing techniques. One such system, taught by Borth, in U.S. Pat. No. 4,628,529, uses the occurrence of minima in the post-processed signal energy in order to control the time at which the background noise measurement is estimated. Specifically, Borth discloses a recursive filter which uses the time averaged value of each speech energy estimate for making a speech/noise decision in performing the background noise estimation. However, the Borth invention was designed to operate in a high noise background and was not adapted for implementation using sophisticated digital signal processing.

In addition, Borth and the other prior art systems have generally focused on accurately estimating either the gain factor or the signal to noise ratio (SNR) of the background noise estimator alone and have not used previously computed estimators or prior instantaneous speech signals at every estimator stage.

Thus, what is needed is a noise reduction system that is useful for high speed digital signal processing and which can cope with time varying noise and various types of noise, including colored noise and white noise, by efficiently using all available noise and speech information. Moreover, what is also needed is a noise reduction system that shows excellent performance over a wide range of signal to noise ratios and is not limited to high background noise applications. What is also needed is a noise reduction system that affords algorithms for deriving more accurate estimators using previous as well as current data. Further, what is desired is a noise reduction system that simultaneously optimizes every estimation step, including the signal to noise ratio, the gain, and the amplitude estimation.

SUMMARY OF THE INVENTION

According to the invention, in a noise suppression system for use with speech, a method for processing noisy speech-containing signals by digital signal processing means in which time-domain speech signals are converted to segments containing time-invariant spectral components, instantaneous signal-to-noise ratio information is calculated and a gain value for each component is obtained with the signal-to-noise ratio information based on prior information and whether the segment is determined to be likely to contain speech. The gain value is employed in an amplitude estimate for each component of the segment, and the components are reconverted into a time-domain signal. The instantaneous signal to noise ratio information is calculated by alternative methods, including recursive algorithms.

Initially, the incoming speech/noise signal is segmented into frequency bins or frames. An instantaneous signal to noise ratio for each frame is computed from an estimate of the log-spectral amplitude. According to the invention, the signal to noise ratio for each frequency bin is derived from exponentially averaging the power level so as to declare the instantaneous power level the noise power level. The signal to noise ratio becomes the ratio of the instantaneous power level to the averaged noise level. Gain is enhanced at low signal to noise ratios. High/low extremes generated in the residual noise removal process are minimized to suppress distortion and atonal noise.

The invention uses adaptive noise estimators which are generated by employing alternative algorithms depending on current and previous noise and speech estimates for each frame. In several embodiments, recursive algorithms which use stored signals and estimators are employed. In one embodiment, a current noise-speech decision determines the algorithm used to calculate background noise estimators for current frames.

In one embodiment, the invention compares current speech estimators to stored estimators to permit smoothing of the speech estimator. In another embodiment, the invention uses a speech-no speech decision and adaptive estimation to permit speech smoothing.

The invention may best be understood by reference to the following description when taken in conjunction with the accompanying drawings.

DESCRIPTION OF THE PREFERRED EMBODIMENT

The invention is a real-time system which detects and selectively screens noise in the present of speech using adaptive estimation techniques. Adaptive estimation as used herein includes selecting between alternative algorithms to calculate a current estimator for a frequency bin. The decision for determining which algorithm to use to calculate the adaptive estimator is also based on current and stored noise and speech criteria. Typically, one algorithm is recursive while the other sets the estimator at a constant value depending on current and stored noise and speech criteria.

The invention thus provides virtually noise-free speech in a large variety of wide-band audio applications. The invention greatly improves speech perception and reduces operator fatigue wherever noise interferes with communications.

The invention as described herein uses digital signal processing methods and algorithms to discriminate between noise and speech throughout the audio spectrum. As will become apparent hereafter, the invention is highly adaptive and deals efficiently with many different noise environments. In particular, the invention copes with noises that vary rapidly and deals efficiently with different types of noise, including white noise and colored noise. The invention also provides an improvement in the signal to noise ratio by more than 10 db for input SNR of 15 db or less.

Figure 1:
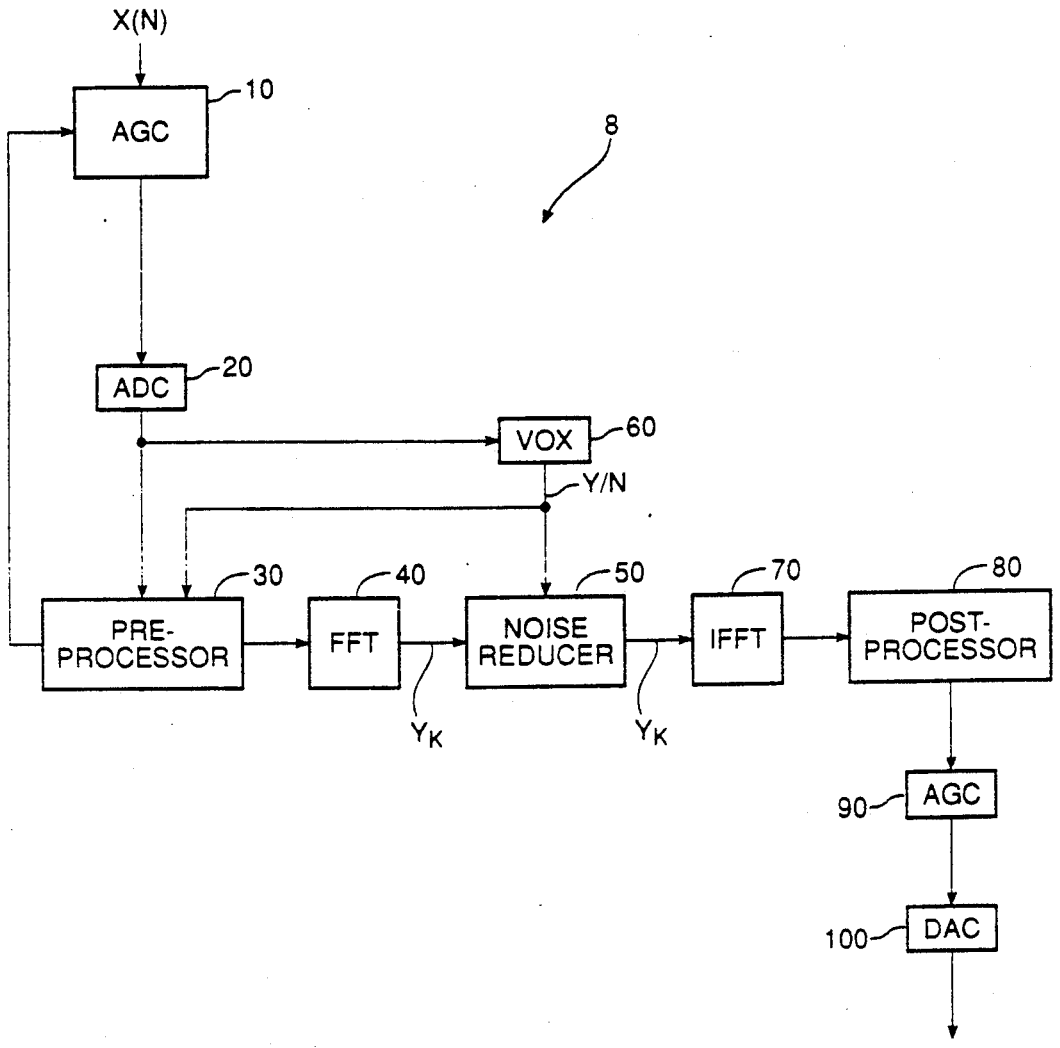
FIG. 1 is a block diagram of a digital processing system for noise reduction, including a noise reduction system.

Inasmuch as the noise reduction system described herein is used interactively with other portions of a digital signal processing system, the overall digital signal processing system in accordance with the invention will be described before discussing the features of the noise reduction system. Refer now to the block diagram for FIG. 1. FIG. 1 shows a generalized digital processing system 8 in accordance with the invention, including a voice activated switch 60 and noise reduction system 50. As shown in FIG. 1, a noisy speech signal X(n) is initially received by an automatic gain control (AGC) stage 10. Input signal X(n) is a continuous time varying signal that over time contains both speech and noise. The AGC stage 10 provides approximately 50 db of dynamic range. The AGC stage 10 uses an array of attenuators controlled by AGC parameters provided by a preprocessing stage 30 in a feedback relationship with the AGC 10. The output of AGC stage 10 is fed to a converter (ADC) 20 which converts the signal from analog to digital form. The ADC 20 may be a linear twelve-bit analog to digital converter or a codec having a sampling rate of 8,000 samples per second. A linear ADC stage must be preceded by an anti-aliasing filter while most codecs have such a filter built in. The digital output of ADC stage 20 is forwarded to a voice activated switch 60 (VOX) and to a preprocessing stage (preprocessor) 30. As illustrated also in FIGS. 2C, 3 and 4, the output of the VOX 60, which provides a binary Speech/No Speech decision, is coupled to the preprocessor 30 and to a noise reducing stage (noise reducer) 50.

Referring still to FIG. 1, the preprocessor 30 segments the digitized signal into overlapping frames. Each frame is pre-emphasized and weighted in the preprocessing stage 30 by an appropriate window for subsequent frequency transformation. During preprocessing, AGC control parameters are also computed, depending on the energy content of each frame.

Figure 3:
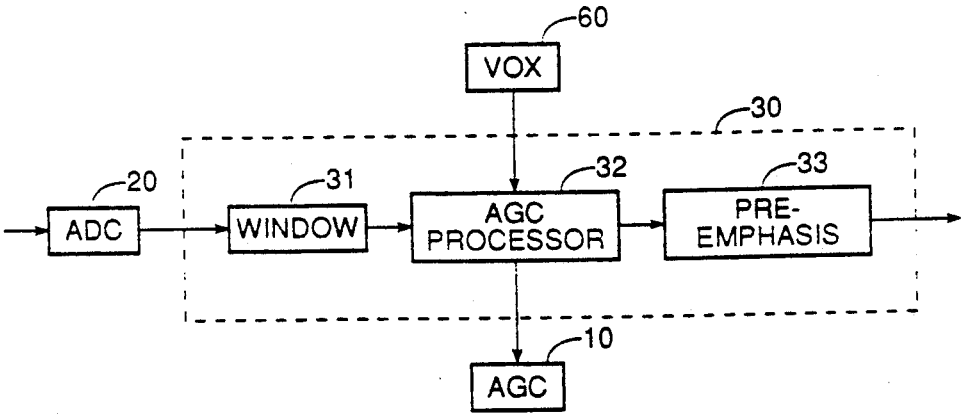
FIG. 3 is a block diagram of the preprocessing subsystem for a digital signal processing system in accordance with the invention.

Referring now to FIG. 3, there is shown a block diagram of the preprocessing stages of a preprocessor 30 used in the system according to the invention. As is generally appreciated, because of the non-stationary nature of speech itself, the initial speech signal X(n) must be segmented into segments or frames by preprocessor 30 so that the stationary nature of the speech can be assumed. Thus, shown in FIG. 3 is a windowing stage 31. In windowing stage 31, frames of 128 samples of 16 milliseconds per frame are formed from the digital signal with 50% overlap. Each frame is weighted by an appropriate window for two reasons: to avoid spectral leakage and to permit continuous processing of input speech. In various embodiments of the invention, a Hanning window is used, because when added to itself with delay of one half the window duration, it sums to unity. This property of the Hanning window fits the requirements of the "overlap add" method used in steps hereafter described. As further shown in FIG. 3, automatic gain control parameters are also generated at an AGC processor 32 and are used to adaptively estimate the peak energy of integrals classified as speech by the VOX 60 (FIG. 1). AGC processor 32 also sends a signal to the AGC stage 10 to control each attenuator according to its corresponding AGC parameter. The attenuator values are such that no switching side effects are heard at the digital processing system output. The dynamic range of the system is up to 50 db. Finally, in preprocessing stage 30, a pre-emphasis can be introduced without affecting intelligibility because the first format is less important perceptually than the second one. Pre-emphasis is performed on each frame according to the following recursive formula:

$$X(n) = Y(n) - a \cdot Y(n-1)$$

where

Y(n−1)=previous input sample for the current frame;

Y(n)=current sample;

X(n)=pre-emphasized sample; and a=a pre-emphasis coefficient.

Returning now to FIG. 1, it is seen that the frames X(n), output from preprocessing stage 30 are coupled to the fast Fourier transform (FFT) stage 40. In FFT stage 40, a short time Fourier analysis is performed on each frame. Each time frame of the noisy speech is converted into the frequency domain using a fast Fourier transform algorithm. As further shown in FIG. 1, frames of noisy speech that have been converted into the frequency domain with spectral components $Y_k$ are coupled from FFT stage 40 to a noise reduction stage (noise reducer) 50. The noise reducer 50 includes noise reduction features to be discussed in detail hereinafter. The noise reducer stage 50 operates to provide at its output an enhanced speech signal with enhanced spectral components $X_k$ having very low background and residual noise content. Noise reducer 50 takes advantage of the major importance of the short time spectral amplitude of the speech signal and its perception, and utilizes a mean square estimator for enhancing the noisy speech. The noise reducer 50 is also responsive to VOX switch 60 as an indicator of the presence or absence of speech and uses previously stored signals as will be described in greater detail hereafter.

The VOX switch 60 is used to provide a reliable speech/no-speech (Y/N) decision given an input signal even under severe noise conditions. This speech decision is used during the estimating stages for the noise reducer 50. One example of a VOX switch which may be used is "disclosed in the pending Israeli patent application Ser. No. 84902 filed Dec. 21, 1987 corresponding to U.S. application entitled "Voice Operated Switch", Ser. No. 151,740 filed Feb. 3, 1988, now U.S. Pat. No. 4,959,865 issued Sept. 25, 1990 [Disclosure 11685-4] or in the commercial product SMARTVOX available at the time of the filing of the parent application from The DSP Group, Inc. of Emeryville, Calif. The VOX 60 is useful for eliminating unnecessary computation on non-speech (i.e., background noise) segments. As such other suitable switches can be used for this purpose. The voice operated switch in the above-referenced disclosure examines a segment of input signal to determine if it has periodic or harmonic content, which is an indication of the presence of a voiced phoneme and thus the presence of speech. Other VOX devices which might be used are energy threshold detectors, as are common in the art of analog signaling. If the VOX 60 is an analog signal device instead of a digital device, the VOX input may be derived from the analog output of the AGC 10. The input to the VOX 60 is merely shown as a representation of one possible implementation.

Referring still to FIG. 1, shown coupled to the output of noise reducer 50 is an inverse fast Fourier transform (IFFT) stage 70. In this stage, the enhanced spectral components are transformed back to the time domain in order to reconstruct the signal. The IFFT stage 70 uses an inverse fast Fourier transform algorithm to convert frequency domain frames back into the time domain. Output frames from the IFFT stage 70 are fed to a post-processing stage 80. The post-processing stage 80 reconstructs the enhanced frames using the weighted overlap add method and de-emphasis in order to restore natural speech spectral rolloff in accordance with conventional teachings. An output AGC stage 90 is coupled to the output of the post-processing stage 80 for controlling the level of the digital signal input to an output DAC 100. The output of the output DAC 100 is the audible enhanced speech having reduced background and residual noise levels.

Having thus described the overall digital processing system in accordance with the invention, the noise suppression system of the invention will now be described, first by reference to the prior art techniques and then by describing the features and methods used in operation of the invention.

Figure 2A:
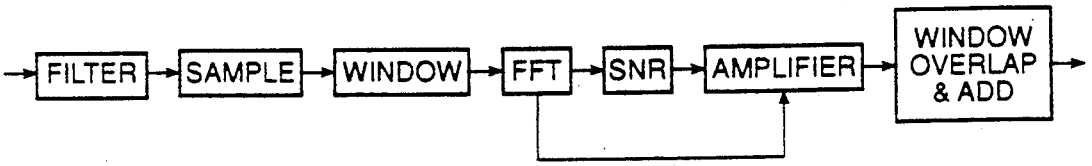
FIG. 2A (PRIOR ART)
FIG. 2A is a block diagram of a prior art digital processing system using a mean square estimating technique in its noise reduction system.
Figure 2B:
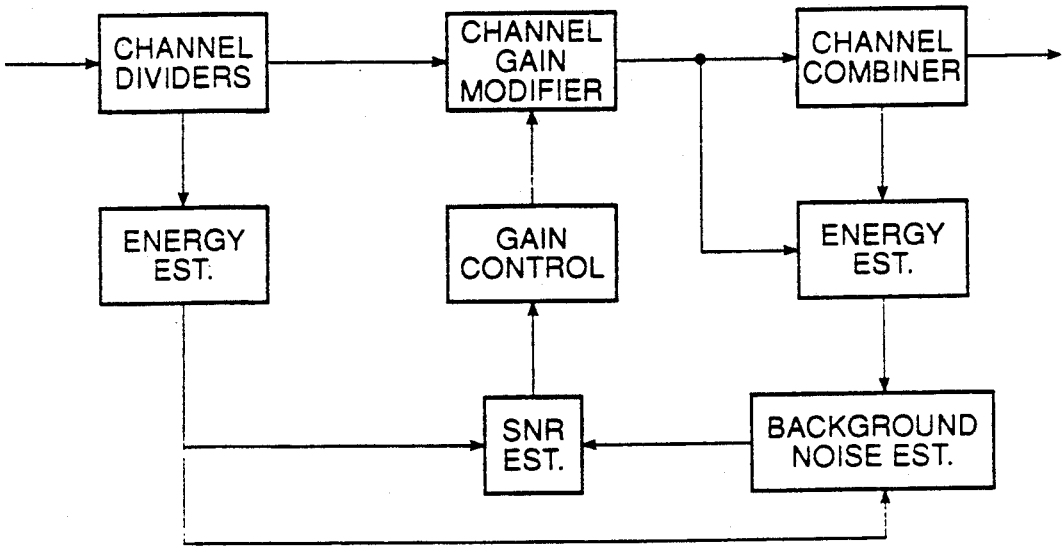
FIG. 2B PRIOR ART
FIG. 2B is a block diagram of another prior art system employing limited post processing feedback to enhance noise reduction.

Refer now to prior art noise suppression systems in FIGS. 2A and 2B. FIG. 2A depicts a system as taught by Ephraim and Malah which used the minimum mean square log estimators. The system shown in FIG. 2A is a feed-forward system and does not fully eliminate noise components. As taught by Ephraim and Malah, the system does not disclose or suggest calculation of residual noise estimators or any gain limiting or smoothing techniques nor does the system use recursive algorithms to learn the background noise.

FIG. 2B shows a noise suppression system as taught by Borth. The system disclosed in FIG. 2B uses post-processed signals in making the speech noise decision. However, this system specifically relies on detecting valleys in post-processed signals and thus is most useful for high noise applications. In addition, the system is intentionally simple and is not intended for sophisticated data processing applications.

Figure 2C:
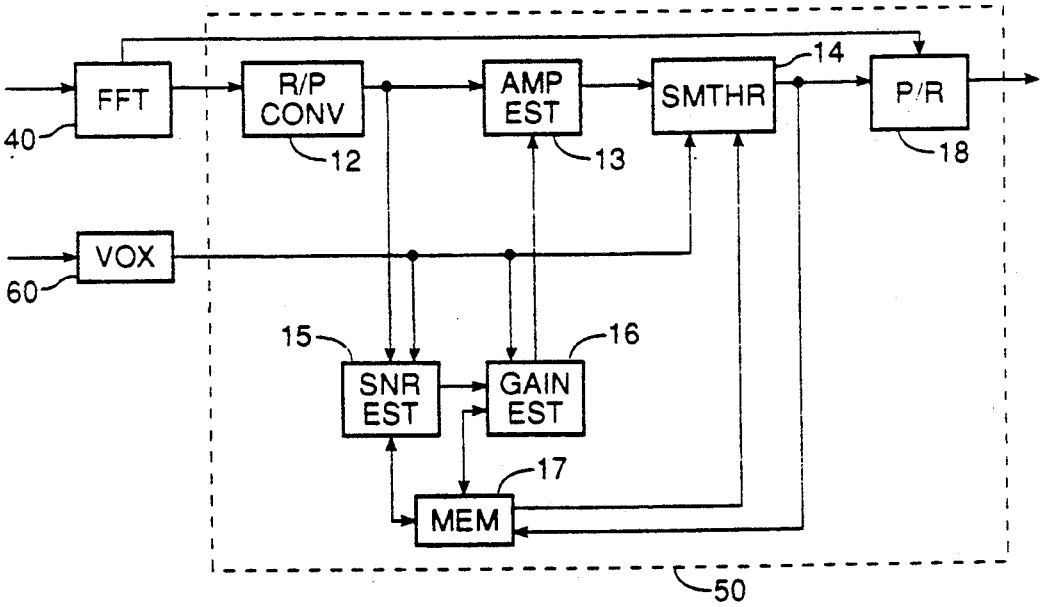
FIGS. 2C and 2D are generalized block diagrams of differing embodiments of the invention.
Figure 2D:
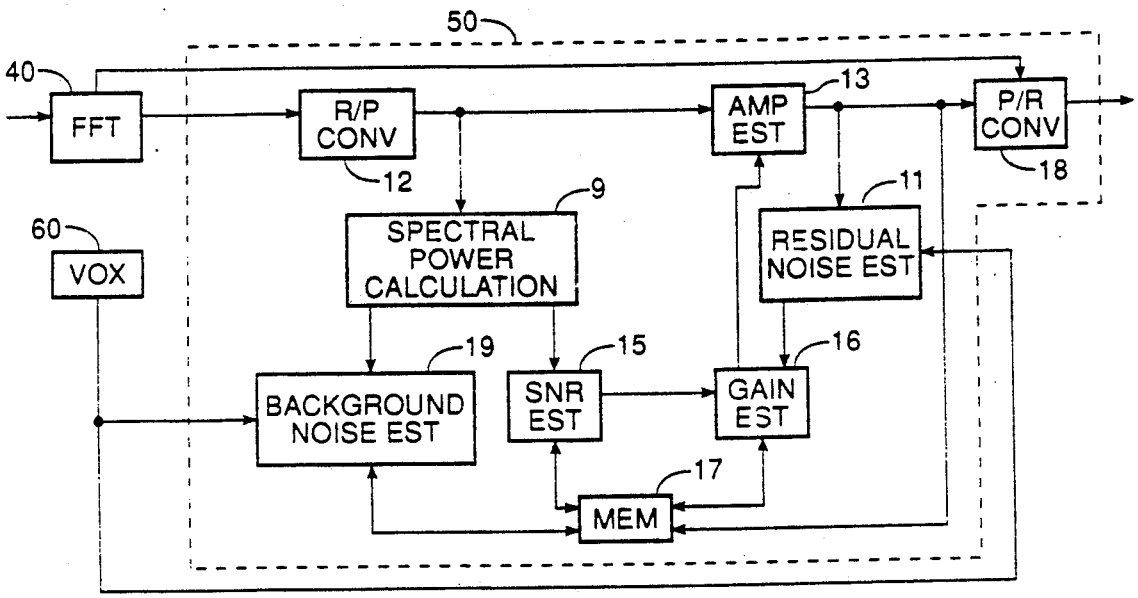
Figure 4:
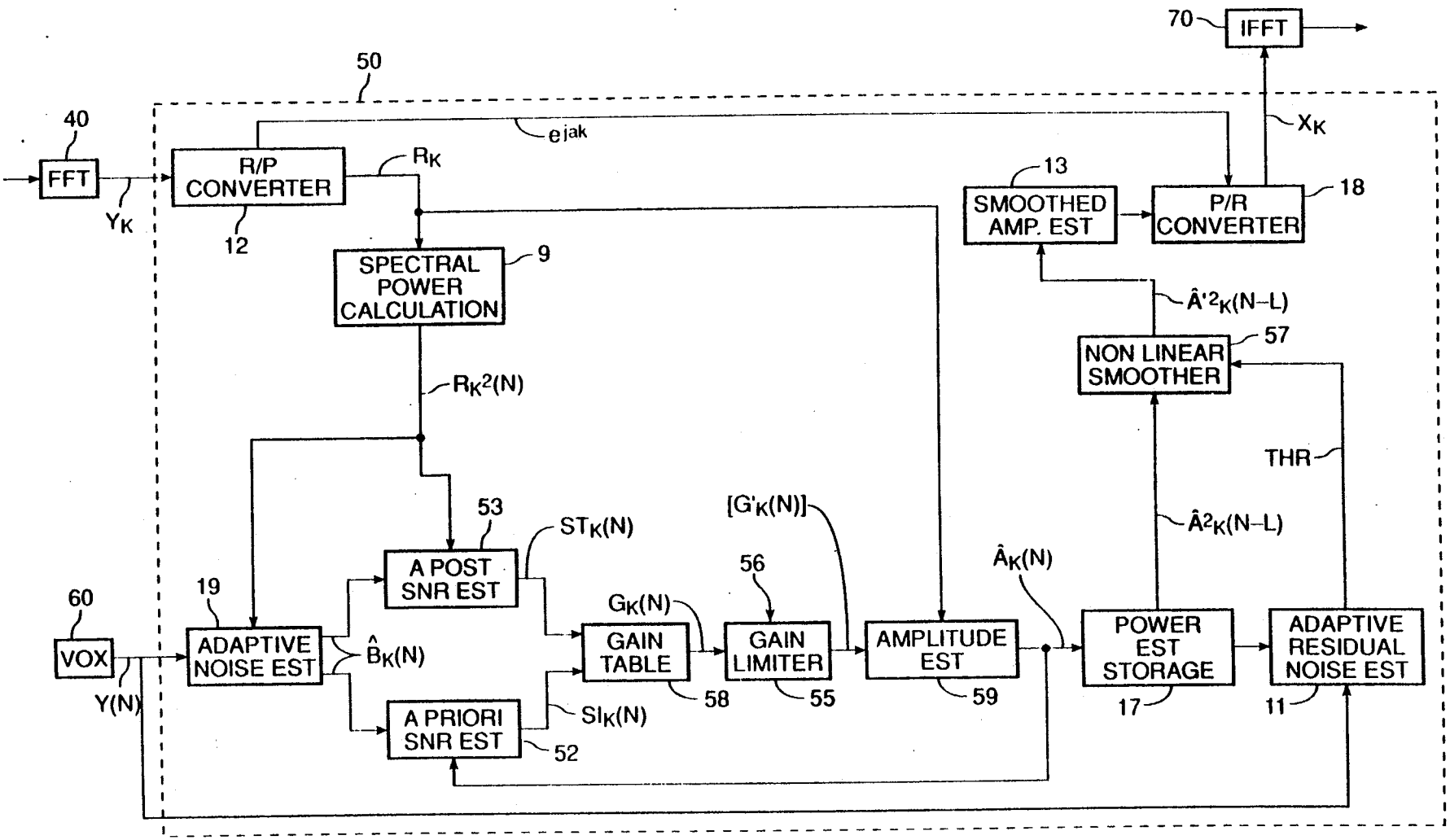
FIG. 4 is a detailed block diagram of another embodiment of a noise reduction system in accordance with the invention.

Refer now to FIGS. 2C, 2D and 4 which set forth in block diagram form various embodiments of the noise reduction system in accordance with the invention. It should be noted at the outset that one of the features of the invention which permits greater noise reduction is the manner in which the invention recursively uses stored signals to generate a plurality of estimators. It is also noted that the invention uses residual noise estimators as well as background noise estimators to generate other estimators. In addition, the invention uses voice activated decisions to generate the residual and background noise estimators. Further, the noise reduction system of the invention uses a minimum mean square error log spectral amplitude estimator technique, which exploits the notion that principally the short time spectral amplitude rather than phase is important for speech intelligibility. Although the invention uses a minimum mean square error log spectral amplitude estimator mathematically similar to that taught by Ephraim, the estimator is applied in a manner and method not heretofore disclosed.

FIG. 4 in particular depicts a specific embodiment of a noise reducer 50 in accordance with the invention. In the following discussion, "k" denotes the spectral component and "n" denotes the frame at time T=n. It must be understood that the noise reducer 50 operates in the frequency domain so that all processing is done on spectral components of time-invariant samples of a frame. In a specific embodiment, each segment of 128 samples which characterize a frame of the noisy speech signal is converted by means of the fast Fourier transform processor FFT 40 into 64 spectral components in the frequency domain $Y_1$ through $Y_{64}$. A parameter "(n)" indicates the "$n^{th}$" frame. Labels in FIG. 4 correlate with the following mathematical description.

For the noise reduction systems of FIGS. 2C, 2D and 4, the problem of formulating the correct speech estimator, i.e. the amplitude estimate $A_k$, is the problem of estimating the amplitude of each Fourier expansion coefficient of the speech signal given the noisy signal. In the minimum mean square log method, the Fourier expansion coefficient of the speech signal as well as of the noisy signal are modelled as statistically independent Gaussian random variables. Mathematically, the analysis can be expressed as follows:

Let $X_k$ denote the kth Fourier expansion coefficient of the speech signal and let $Y_k$ denote the noisy observations in the internal 0 (zero) to T. Further let $$X_k = A_k \cdot e^{jak}$$

and $$Y_k = R_k \cdot e^{jak}$$

Then $A_k$ may be defined as the estimate which minimizes the following distortion measure:

$$L = E[(\log A_k - \log A_K)^2]$$

It can be shown that this amplitude estimator is given by $A_k = \exp\{E[(1n\ A_k/Y_k)]\}$ Using the assumed statistical model, it can be further shown that the desired amplitude estimator $A_k(n)$ is obtained from $R_k(n)$, the noisy signal, by a multiplicative, non-linear gain function which depends only on the a priori and the a posteriori signal to noise ratios, $SI_k(n)$ and $ST_k(n)$, respectively. This gain function is defined by:

$$G_k(n) = G(SI_k(n), ST_k(n)) = \frac{A_k(n)}{R_k(n)}$$

or $$A_k(n) = G(SI_k(n), ST_k(n)) \cdot R_k(n)$$

where n denotes the interval of time, and K the spectral component under consideration.

Thus, as is apparent from the above mathematical formula, $A_k$, the proper amplitude estimator, is determined by multiplying $G_k$, the proper gain estimator, times $R_k$, the given noisy observed speech signal. Thus, to determine $A_k$, $G_k$ must be determined. In order to determine $G_k$, first the a priori SNR, $SI_k$, and the a posteriori SNR, $ST_k$, must be determined. According to the invention, these values are adaptively determined, stored, and recursively used to generate noise free speech.

Refer now to FIGS. 2C and 2D which depict block diagrams of noise reduction systems in accordance with differing embodiments of the invention. Referring first to FIG. 2C, there is shown in a noise reduction system 50 a rectangular to polar converter stage 12 for separating each spectral component of an input frame $X_k(n)$ into amplitude and phase information.

Noisy amplitude information $R_k(n)$ for each frame is fed from rectangular to polar (RP) converter 12 to amplitude estimator 13 and to signal to noise ratio SNR estimator 15. RP converter 12 is operative to separate the spectral amplitude components $R_k$ from the phase component $e^{jak}$ to permit processing of the spectral components. SNR estimator 15 is responsive to inputs from VOX switch 60 and to a memory 17. The output of SNR estimator 15 is fed to gain estimator 16. Gain estimator 16 is also responsive to inputs from VOX switch 60 and memory 17. The output $G_k(n)$ of gain estimator 16 is coupled to amplitude estimator 13 which is also fed the output $R_k(n)$ of RP converter 12. The output $A_k(n)$ of amplitude estimator 13, i.e. the noise suppressed signal, is the product of $G_k(n) \cdot R_k(n)$ and is fed through smoother 14 to polar rectangular converter 18 and to memory 17. Memory 17 provides stored instantaneous values of $A_k(n)$, $G_k(n)$, and SNR signals to SNR estimator 15, to gain estimator 16 for generating SNR estimators and gain estimators $G_k(n)$. Memory 17 also provides stored values to smoother 14. Polar to rectangular converter 18 combines the estimated amplitude $A_k(n)$ with the noisy phase as the first step in the signal reconstruction process in accordance with conventional teachings. P to R converter 18 is the final stage in the noise suppression stage 50 as shown in FIG. 2C.

Refer now to FIG. 2D. FIG. 2D is a block diagram of another embodiment of the invention. The embodiment in FIG. 2D is similar to the embodiment in FIG. 2C; however, additional features are shown in FIG. 2D. In particular, residual noise estimator 11 is included in the feedback path for noise suppressed signals, and the output of residual noise estimator 11 is used in generating gain estimators in gain estimator 16. Residual noise estimator 11 is responsive to a speech/no-speech (Y/N) decision from VOX switch 60. Also shown in FIG. 2D is a background noise estimator 19 included in the feed forward path to SNR estimator 15. Background noise estimator 19 is also responsive to a speech/no-speech decision from VOX switch 60. The output, $B_k(n)$, of background estimator 19 feeds SNR estimator 15 which is also fed by spectral power stage 9 and memory 17.

Refer now to FIG. 4, a more detailed embodiment of the invention. Referring to FIG. 4, it can be seen that the SNRs are determined based in part on the output of adaptive background noise estimator 19. The background noise estimator 19 is in turn controlled by decisions from the VOX switch 60. The VOX switch 60 in turn classifies speech segments as speech or non-speech. Segments classified as no speech are processed by an adaptive algorithm acting on the power of each spectral component to generate adaptive background noise estimators. Through use of the VOX decision, the system is able to process frames with the knowledge that speech or no speech is being processed at any one instant. In this way, the background estimator $B_k(n)$ can be updated each time a non-speech decision is made by the VOX.

Referring still to FIG. 4, it is seen that background noise estimator 19 is fed from spectral power calculation block 9 which provides the spectral power $R_k^2(n)$ of the noisy observation $R_k(n)$.

Background noise estimator 19 also is fed a speech-/no speech (Y/N) signal from VOX switch 60. Given the speech/no-speech decision and spectral power input, background noise estimator 19 calculates the background noise estimator $B_k(n)$ according to the following adaptive algorithm:

If speech, then $$B_k(n)=B_k(n-1)$$

i.e. no updating is performed.

If no speech, then $$B_k(n)=(1-a)B_k(n-1)+aN_k(n)$$

where a=a constant, and $N_k(n)=R_k(n)$, a being set to 0.1 in one embodiment. This adaptive algorithm is performed by the adaptive noise estimator 19.

The output of adaptive (background) noise estimator 19 is thereafter fed to a posteriori estimator 53 and a priori estimator 52. Thus, it can be seen that any variation in the background noise is rapidly detected and used to update the background noise estimator which is used in the SNR estimator.

The a posteriori SNR is computed by the a posteriori signal-to-noise ratio (SNR) estimator element 53 (see also FIG. 10) according to the following formula:

$$ST_k(n) = \frac{R_k^2(n)}{B_k(n)}$$

wherein $R_k(n)$ is the current observed noisy spectral amplitude for the kth spectral component and $B_k(n)$ is the noise estimator for the current spectral component.

Given the background noise estimator and the a posteriori estimator $ST_k(n)$, the a priori SNR, $SI_k(n)$, can be determined at a priori estimator 52 using a decision directed method.

The proposed estimator for the a priori SNR is a decision directed estimator because the SNR is updated on the basis of a previous amplitude estimate. The a priori SNR is calculated by the a priori SNR estimator element 52 recursively using the following formula:

$$SI_k(n)=(G^2_k(n-1)ST_k(n-1))a+((1-a)P[ST_k(n)-1])$$

where P(k)=X if x>o, and O otherwise. From the foregoing equation, it can be seen that the a priori SNR is calculated using the prior values of the gain estimate $G_k(n-1)$ and the prior and current value of the posteriori SNR, $ST_k$. The "a" is a weighting factor and has a value in one embodiment between 0.9 and 0.95.

As a further explanation of the foregoing, and in order to make it clear that the a priori estimator element 52 employs a past amplitude estimate, consider the following: From the above discussion of the derivation of the proper amplitude estimator it is known that:

$$A_k(n)=G_k(n)\cdot R_k(n)$$

and that:

$$ST_k(n)=R^2_k(n)/B_k(n).$$

Therefore, replacing terms, the foregoing equation for the a priori SNR, $SI_k(n)$, becomes:

$$SI_k(n)=[A^2_k(n-1)/B_k(n-1)]\cdot a+(1-a)\cdot P[ST_k(n)-1].$$

Use of the past value of the gain estimate and the past value of the a posteriori SNR, as explained hereinafter, is equivalent to use of the past amplitude estimate and the background noise estimate, as explained hereinabove. A stored iteration (e.g., memory block of element 59) holding the previous values as noted is coupled in feedback relation to a priori SNR estimator element 52, indicating the recursive nature of the process.

Referring still to FIG. 4, once the a priori signal to noise ratio and the a posteriori signal to noise ratios are calculated, the results are used to determine a gain estimator $G_k(n)$ from a gain table 58 according to conventional teachings.

In severe noise conditions, background musical noise will appear for some prior art systems. In order to overcome this problem, gain limiter 55 is introduced to further modify the gain estimate $G_k(n)$ to $G_k'(n)$. The effect of limiter 55 is to create a spectral floor which masks musical noise. This approach is based on the fact that broadband noise is more pleasant to a hearer than narrow band noise. The limiting threshold may be controllable from an external source 56 (not shown). The gain limiting algorithm limits the lower bound of the gain to a preset value, allowing the operator to change the spectral floor according to environment noise conditions.

The limited gain estimate $G_k'(n)$ is then fed to amplitude estimator 59. In amplitude estimator 59, the noisy signal $R_k(n)$ is multiplied times the modified gain estimate $G_k'(n)$ to generate a noise suppressed signal $A_k(n)$.

The purpose of smoother stage 57 is to eliminate residual noise components observed as isolated peaks by using a non-linear smoothing algorithm based on residual noise estimates and stored signals. It implements the algorithm depicted in FIG. 14. The residual noise estimator 11 performs adaptive estimation based on VOX decisions. It implements the algorithm depicted in connection with FIG. 8. The residual noise estimator 11 uses a dual time constant scheme based upon adjacent prior estimates and reduces spectral peaks due to random variations in residual noise.

The residual noise estimator is used as a threshold for activating the non-linear smoother 57.

Referring again to non-linear smoother 57 in FIG. 4, the smoother 57 modifies the output of amplitude estimator 59 using a non-linear smoothing algorithm based on inputs from a memory which is a storage circular buffer 17. This buffer 17 stores L previous squared values of each prior spectral estimate $A_k(n-1)$, $A_k(n-2)$ . . . $A_k(n-L)$. The smoother 57 is activated selectively depending on whether the residual noise estimate exceeds a predetermined threshold THR. The smoothed amplitude estimate element 13 receives the smoothed power spectral estimate and computes its square root to obtain the final smoothed spectral amplitude estimate.

Afterwards, the final smoothed spectral amplitude estimate is combined with the noisy phase at PR converter 52 as the first step in signal reconstruction by converting the spectral amplitude and phase information in polar notation into real and imaginary components in rectangular notation.

Figure 5:
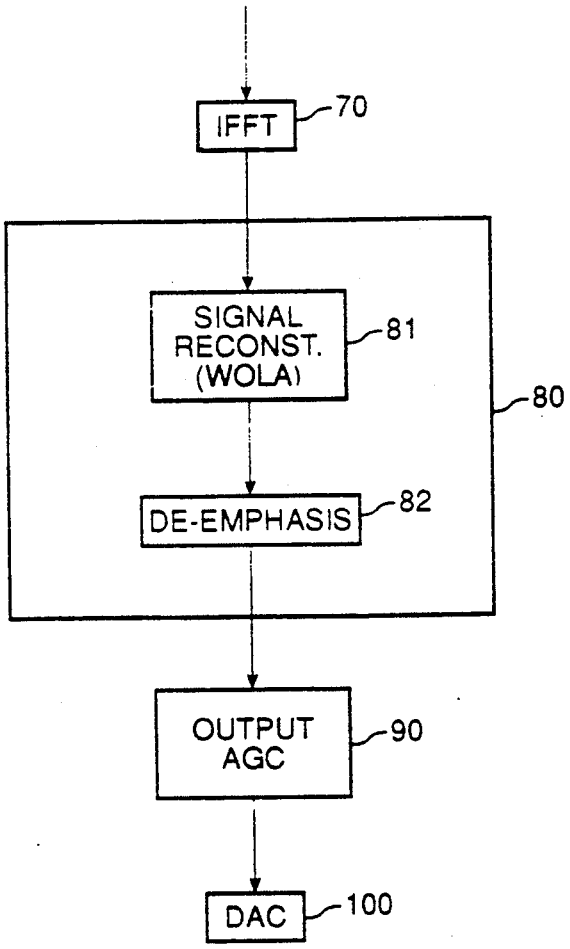
FIG. 5 is a block diagram of a post-processing subsystem for a digital processing system in accordance with the invention.

Refer now to FIG. 5, which describes the post-processing step. The enhanced spectral components are time Fourier transformed 70 and the signal is reconstructed using the weighted overlap and add method 81.

The de-emphasis step 82 restores the natural speech spectrum roll-off using the following recursive (time domain) equation acting on the reconstructed samples:

$$X(n)=W(n)+b\cdot X(n-1)$$

where

W(n)=Reconstructed sample

X(n)=De-emphasized sample

X(n−1)=Previous de-emphasized sample b=De-emphasis coefficient

The above variables X, Y and W depict recursive equations of the pre-emphasis and de-emphasis steps in the time domain, relating consecutive samples within a frame, and are not related to the spectral components defined above.

The goal of the output AGC 90 is to restore the original speech energy envelope. The amplitude estimate algorithm assumes the frequency components to be statistical independent random variables. This fact can affect the overall energy of the clean speech. In order to preserve the original energy envelope of the signal, the following AGC algorithm is applied:

When the VOX detects a "speech" frame, the energy before and after noise cancelling and the total background noise estimate are computed respectively as follows:

$$Eb(n) = \sum_{k=1}^{64} R_k^2(n)$$

$$Ea(n) = \sum_{k=1}^{64} A_k^2(n)$$

$$E_N(n) = \sum_{k=1}^{64} B_k^2(n)$$

An estimation of the speech energy is made by substracting the total background noise estimate from the total energy before noise cancelling:

$$E_S(n)=E_b(n)-E_N(n)$$

Then the output AGC gain is evaluated as follows:

$$G_{AGC}(n) = \frac{E_S(n)}{E_a(n)}$$

and each frame "n" is multiplied by its corresponding $G_{AGC}(n)$ gain before being converted in the DAC step.

When the VOX detects a "non-speech" frame, an exponentially averaged value of the last $G_{AGC}$ is used as the gain factor for the first 2 seconds of non-speech frames. After 2 seconds of VOX detected "non-speech" frames, the gain is updated using the following recursion:

$$G_{AGC}(n)=\beta\cdot G_{AGC}(n-1)$$

where $0<\beta<1$

The proposed AGC algorithm gives the system immunity against energy envelope distortions, thus preserving the original energy envelope of the clean speech. Otherwise, the intelligibility of the enhanced speech may be degraded.

The foregoing description has provided a functional description of the noise reduction system according to the invention, including various embodiments thereof. The following discussion will describe the operation of various processes and methods mentioned above at various stages of the invention using flow diagrams as illustrations.

Figure 6A:
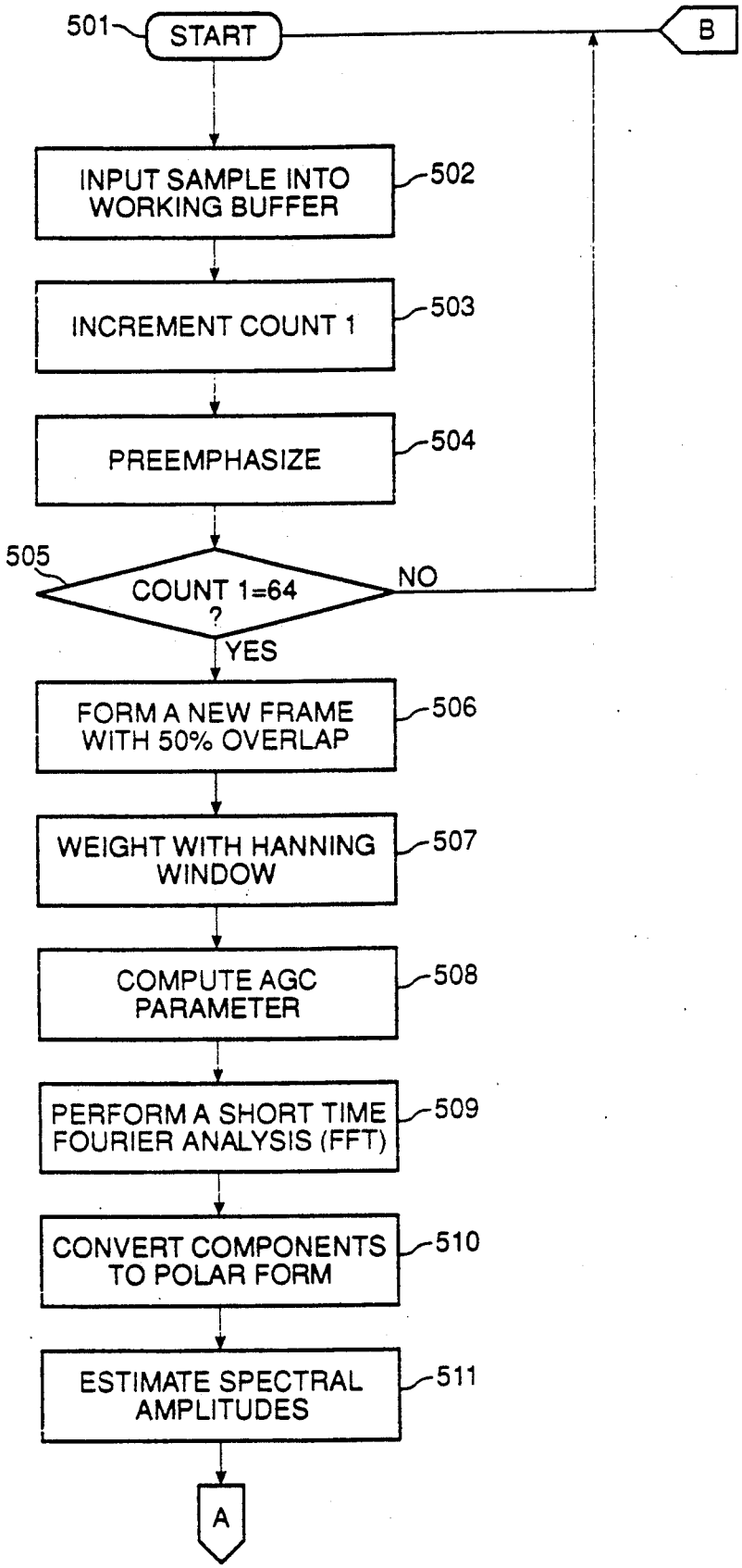
FIG. 6A is a logic flow diagram showing digital processing steps in accordance with the invention.
Figure 6B:
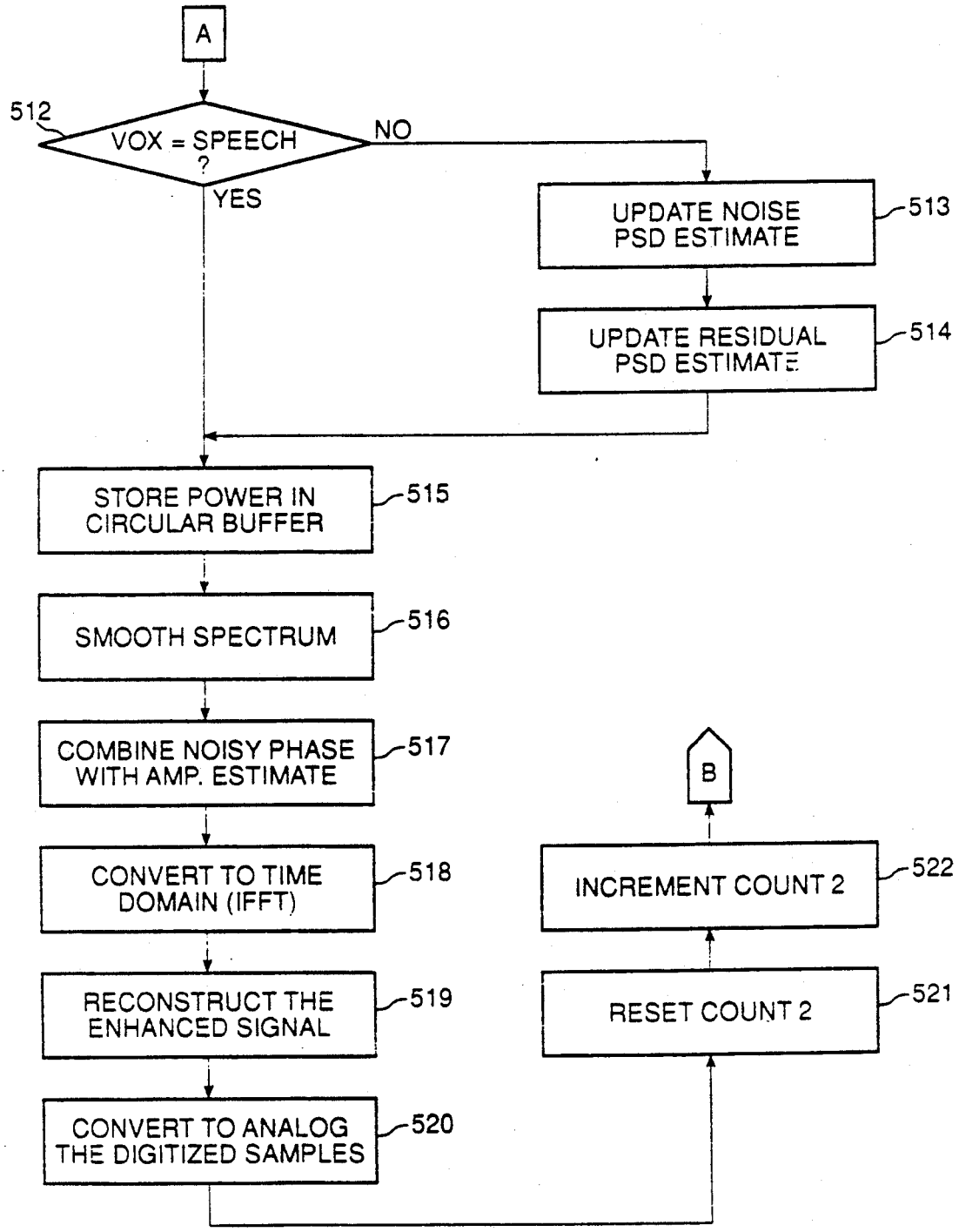
FIG. 6B is a continuation of the logic flow diagram at FIG. 6A showing digital processing steps in accordance with the invention.

Refer now to FIGS. 6A and 6B. A flow chart illustrating the overall operation of the entire digital processing system as shown in FIG. 1 is given in FIG. 6A and continues to FIG. 6B. Functional blocks 511, 513, 514 and 516 of FIGS. 6A and 6B are described in more detail in FIGS. 7, 8, 9 and 14 respectively.

Referring now to FIG. 6A, the operation of the system begins at the starting block 501 which corresponds to the pre-processing stage 30 in FIG. 1. Block 501 represents the powering up of the system and the initialization of the buffers/memories and counters. The incoming signal is digitized by ADC 20 at a sampling rate of 8,000 samples per second. Each sample is stored in a working buffer at step 502 and pre-emphasized in step 504. In operation, the invention performs signal analysis on frames of 128 samples corresponding to 16 milliseconds per frame. Frames overlap by 50%, whereby each frame is constructed by using 64 new samples and by using the last 64 samples of the previous frame. Count 1 in FIG. 6A is a sampler counter used to check if a new block of 64 samples have been received and are ready to be processed. When count 1 equals 64, a new analysis frame is formed.

Next in FIG. 6A, the AGC control parameters are computed as a function of slow varying trends in the signal's energy using an exponential averager with a long time constant that is updated with the energy content of voiced frames as they are detected by the VOX.

When the average value reaches a predetermined threshold, the AGC parameters are changed in order to keep the signal between optimal sample levels. Steps 501 through 508 are performed primarily by preprocessor 30 of FIG. 1.

Following completion of preprocessing step 508, a short time Fourier transform is performed using a 64 point complex FET algorithm. Next, a rectangular to polar conversion is used to calculate the noisy spectral amplitude $R_k(n)$ and the frame is now ready for the amplitude estimation step described in FIG. 7 below.

Referring now to FIG. 6B, steps are shown which indicate the interactive operation of the VOX switch with the noise reduction system of the invention after completion of the amplitude estimation step. As shown in FIG. 6B, initially, the VOX switch decides whether a noisy frame contains speech or no-speech. When the VOX detects a speechless frame, two actions take place.

Figure 8:
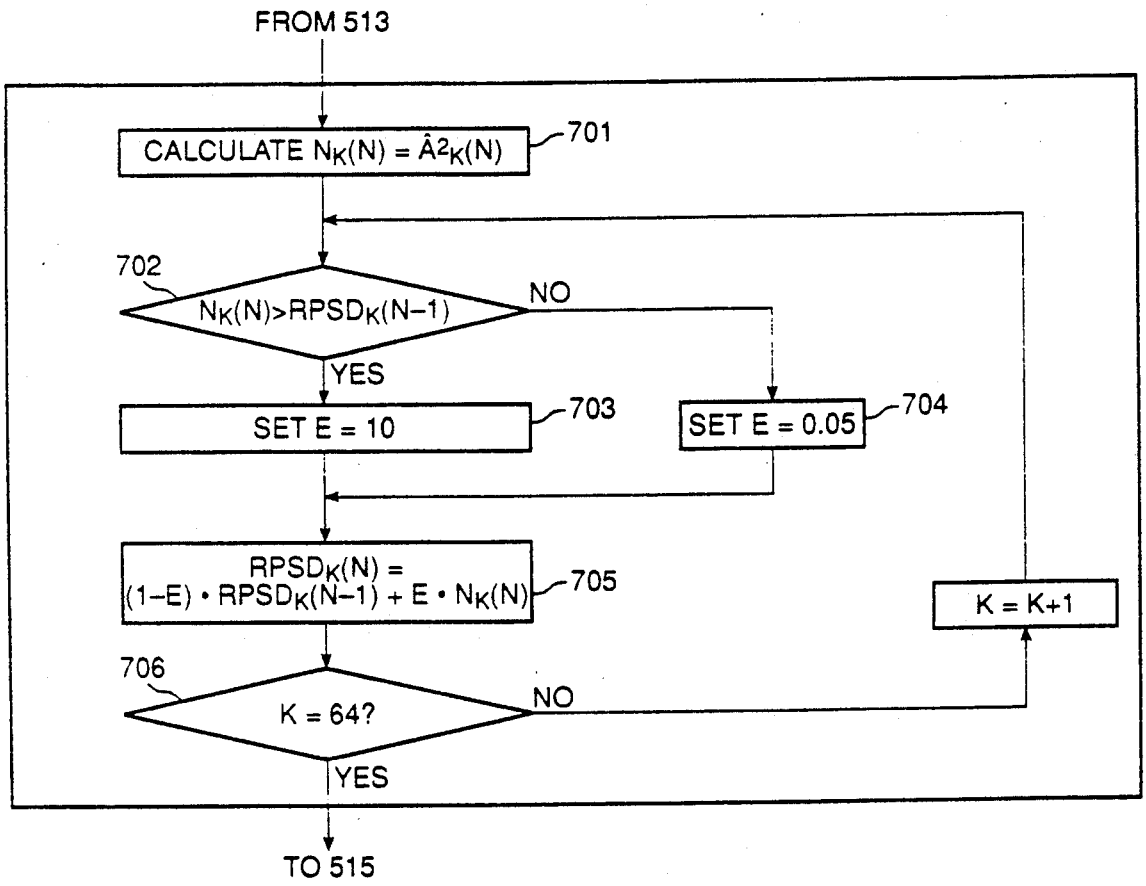
FIG. 8 is a logic flow diagram illustrating the steps for calculating the residual noise estimator, $RPSD_k(n)$, in accordance with the invention.
Figure 9:
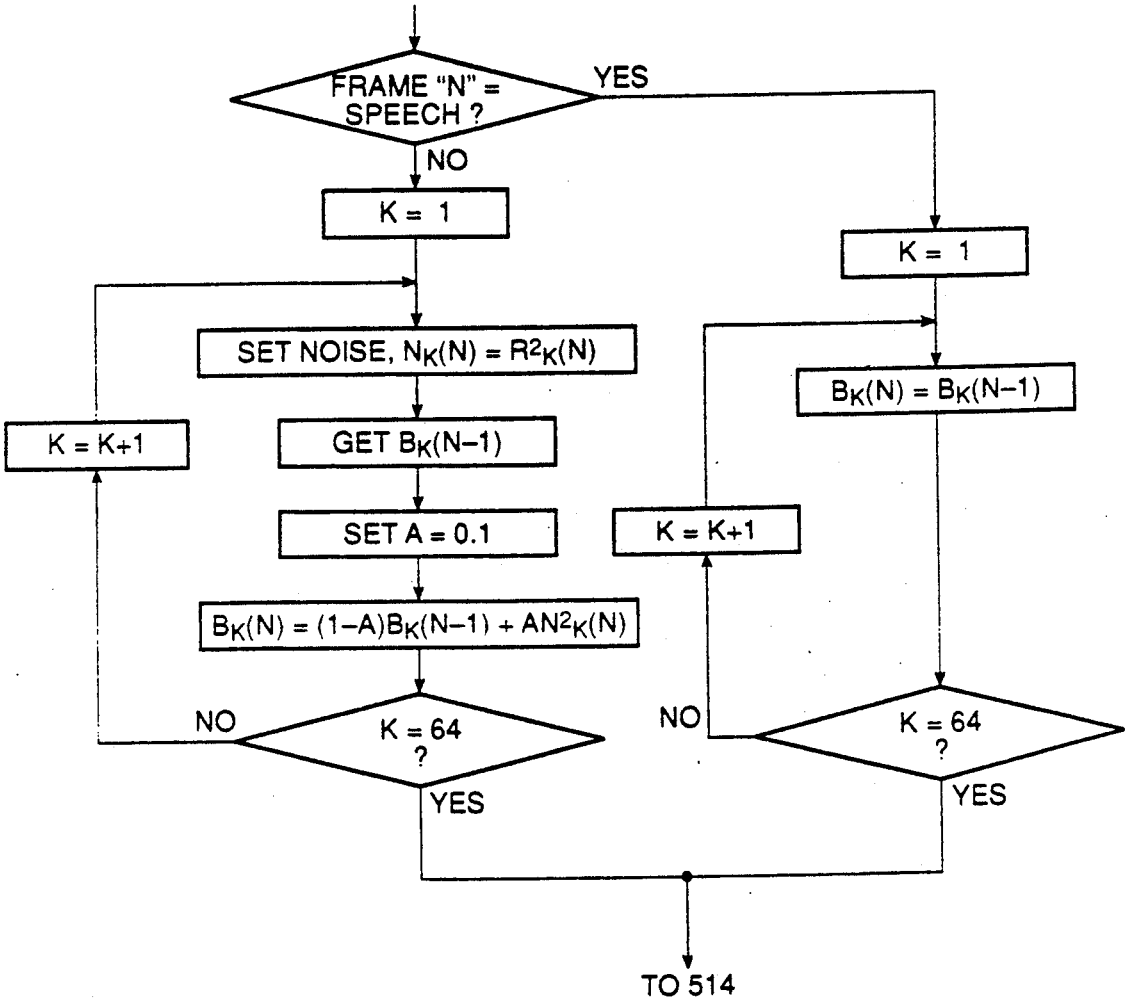
FIG. 9 is a blocked diagram showing the steps for calculating the background noise estimator, $B_k(n)$, in accordance with the invention.

First the noise background estimate is determined recursively as shown in FIG. 9. Secondly, the residual noise estimate is updated using a fast attack, slow decay scheme, as more fully described in FIG. 8 hereafter. The corresponding spectral power $A_k(n)$ of the enhanced components is stored in a circular buffer (memory) which, in the preferred embodiment, contains the last five squared values of $A_k$, i.e. $A_k(n-1)$, . . . $A_k(n-5)$.

After the smoothing step 516 eliminates randomly distributed peaks in the spectrum, the resulting spectral estimate is combined with the noisy phase as shown in block 517.

The enhanced complex spectral components are then time transformed by an inverse FFT method. The resulting frame is weighted and added with 50% overlap to the previous frame, leading to the reconstructed signal 519. Next, the digitized samples are converted to analog form by the digital to analog converter 520, at which time processing for a frame is completed. The frame counter, count 2, is incremented, the sample counter, count 1, is zeroed, and the processing of a new frame begins.

Because of the real time characteristics of the system, the acquisition of new samples in the processing of frames in accordance with FIGS. 6A and 6B are not serial but are parallel processes. Calculations are in progress for an old sample while a new sample is being acquired. Control signals insure that processing proceeds in an orderly fashion.

Figure 7:
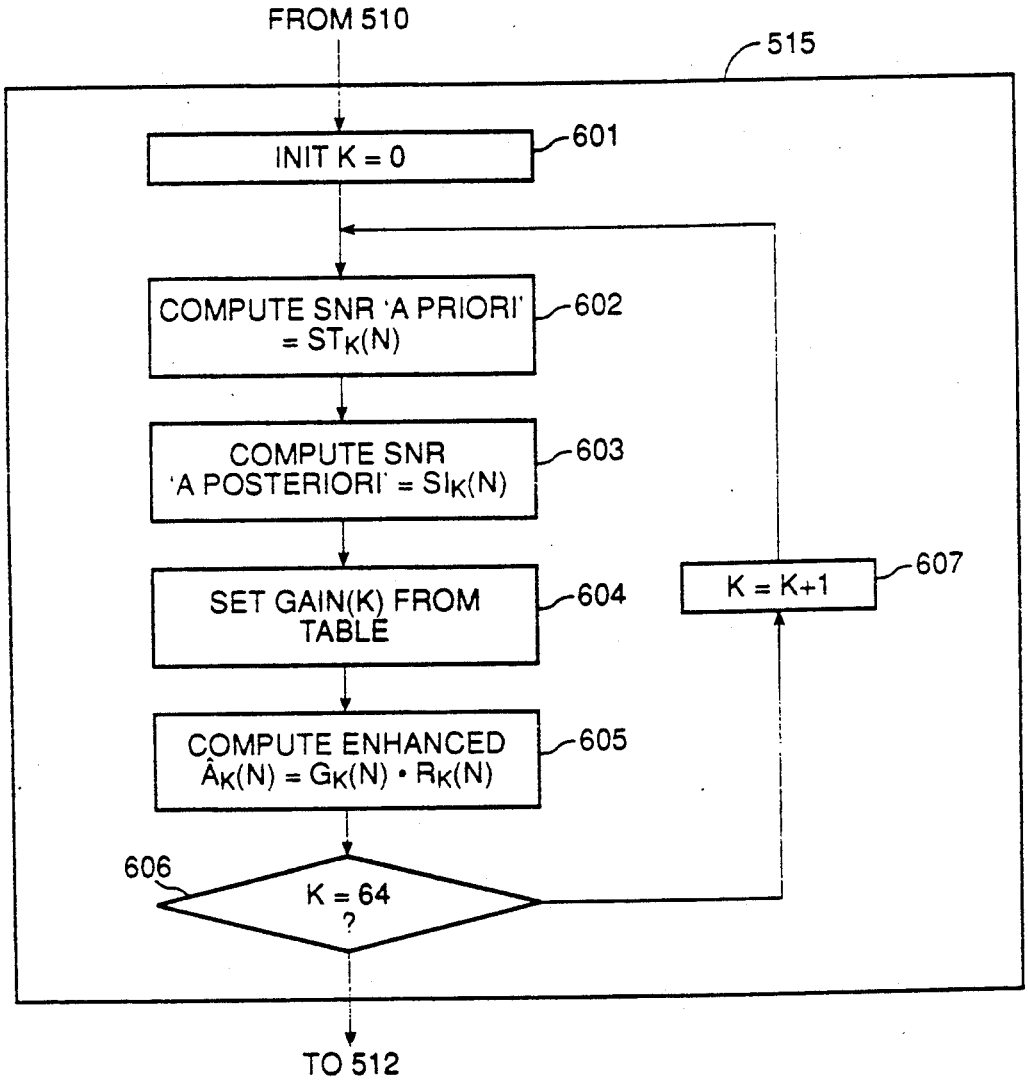
FIG. 7 is a logic flow diagram illustrating the steps for calculating the spectral amplitude estimator, $A_k(n)$, in accordance with the invention.
Figure 10:
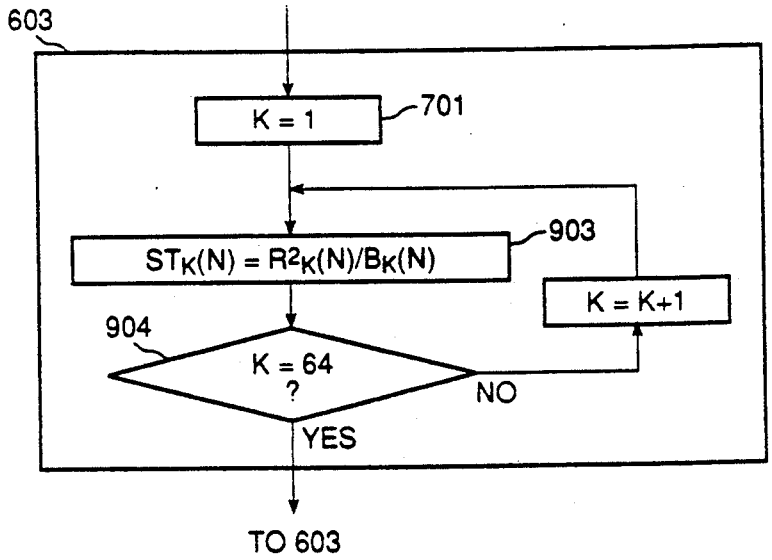
FIG. 10 is a logic flow diagram which sets forth the steps for calculating the a posteriori signal to noise ratio, $ST_k(n)$, in accordance with the invention.

Refer now to FIG. 7 which illustrates the steps in the spectral amplitude estimation calculation step 515. As shown in FIG. 7, from the FFT are obtained 64 spectral samples per frame. For each frame, the following steps are performed. First, the background noise estimate $B_k(n)$ is calculated according to the steps in FIG. 9. Next, the a posteriori signal to noise ratio in calculated using the noisy observation. A flow chart depicting the a posteriori calculation steps is shown at FIG. 10.

Figure 11:
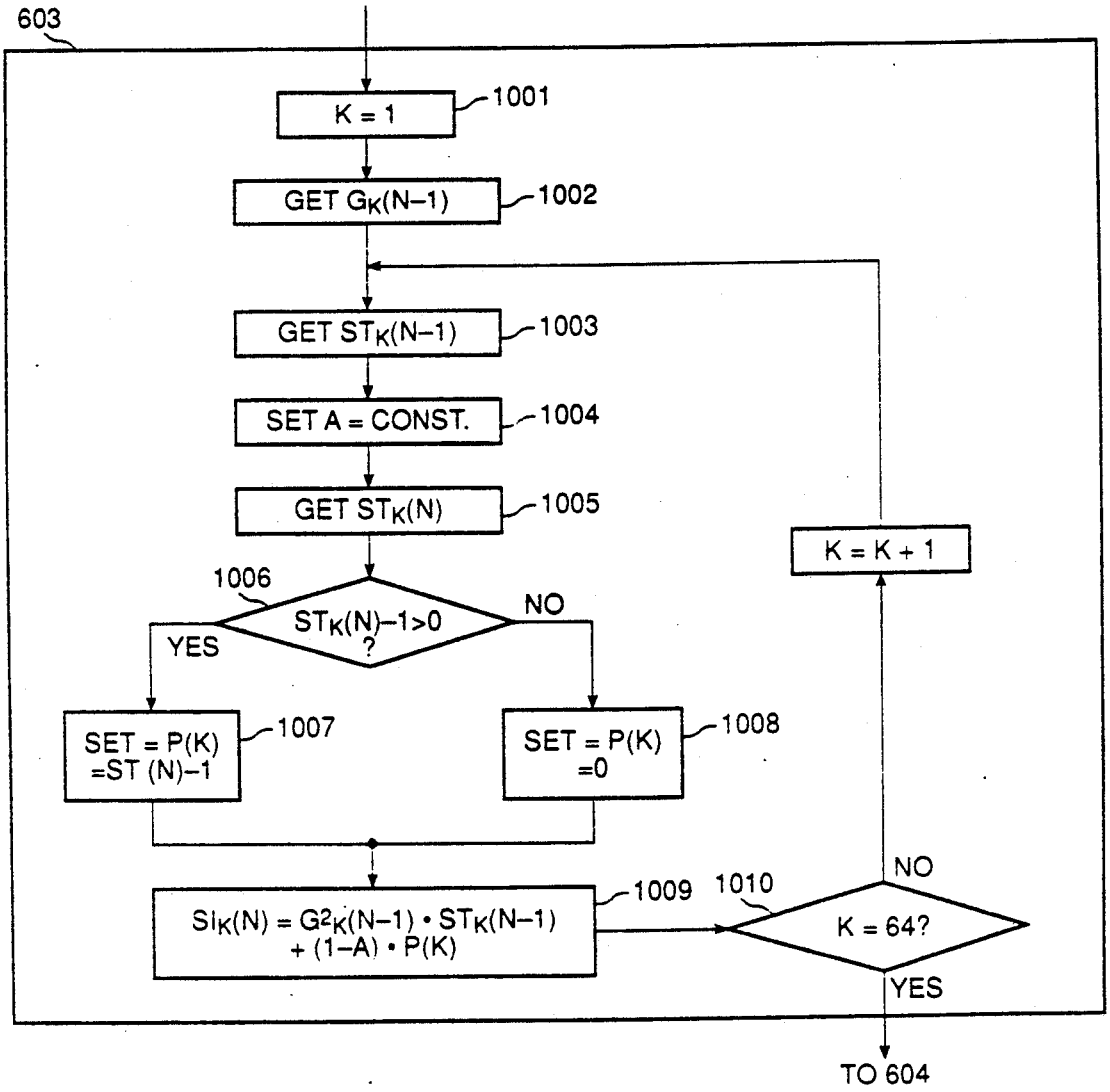
FIG. 11 is a logic flow diagram which sets forth the steps for calculating the a priori signal to noise ratio, $SI_k(n)$, in accordance with the invention.

Next, the a priori signal to noise ratio is calculated using the decision directed approach. FIG. 11 depicts the steps for computing the a priori signal to noise ratio.

Figure 12:
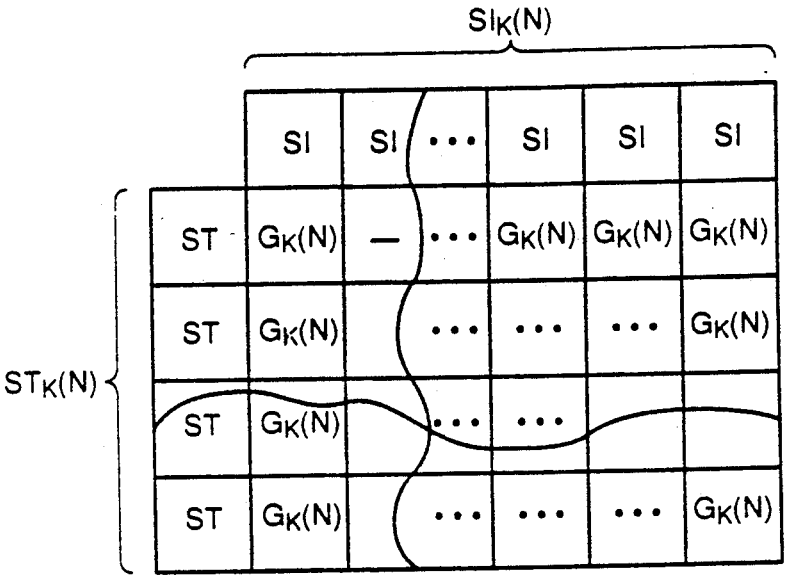
FIG. 12 is a depiction of a gain table in accordance with the invention.
Figure 13:
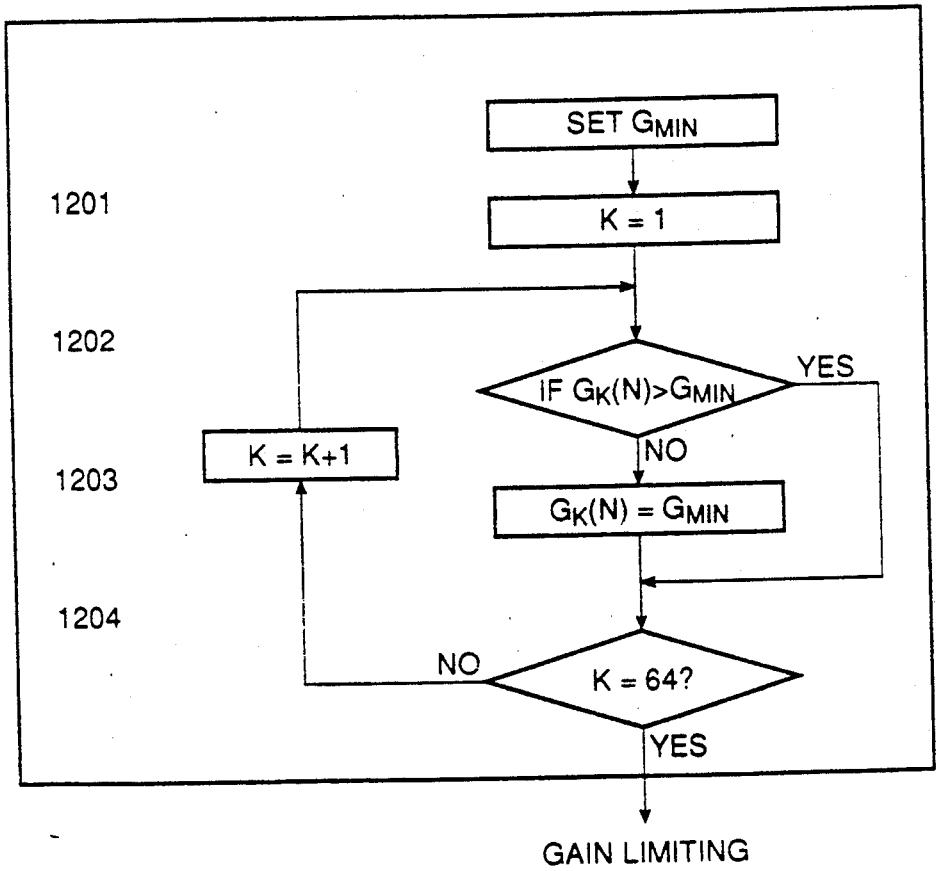
FIG. 13 is a logic flow diagram which sets forth the steps for calculating gain limiting in accordance with the invention.

Next, the gain is computed, using the lookup table in reliance on the a priori and the a posteriori computed estimates. A gain table according to one embodiment of the invention is shown at FIG. 12. Next, an enhanced spectral amplitude estimator $A_k(n)$ is obtained by multiplying the noisy spectral amplitude $R_k(n)$ by the gain estimator $G_k(n)$.

Refer now to FIG. 8. FIG. 8 describes the steps for calculating the residual noise estimator. In FIG. 8, a VOX detects a speechless frame and determines the characteristics of the residual noise. In FIG. 8, $N_k(n)$ represents the estimated power of the kth spectral component of a noise frame $$(\text{i.e. } N_k(n) = A_k^2(n)).$$

As shown in FIG. 8, once $N_k(n)$ is calculated, residual estimator $RPSD_k(n)$ is adaptively updated using a dual time constant averager. The time constant "E" is set to 1 at step 703 if the present component is greater than the residual estimator; otherwise, "E" is set to 0.05 at step 704, giving the averager a fast attack, slow decay behavior. Once the residual noise estimate is derived for the kth component, a counter is reset at step 706 and calculation is repeated for all the 64 spectral components. The output is used in step 516 to smooth the power spectrum.

Figure 14:
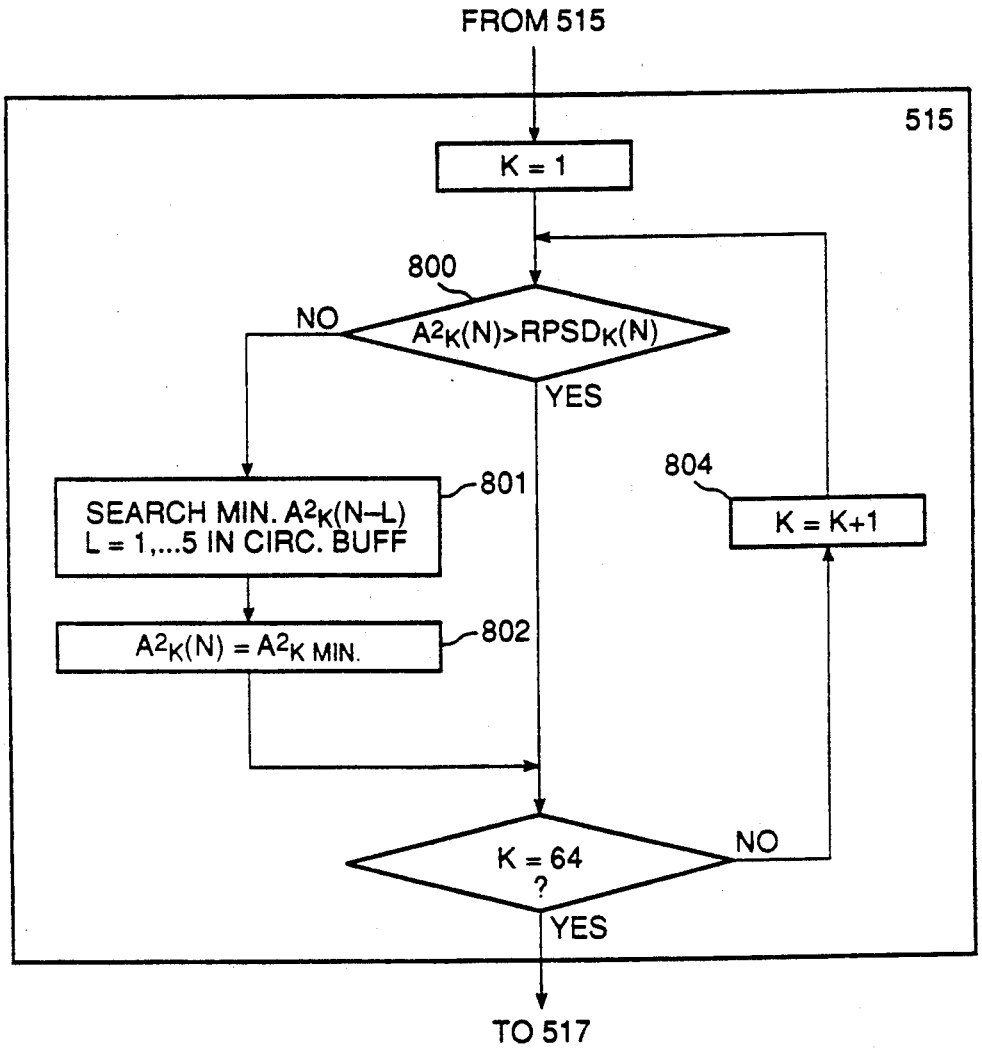
FIG. 14 is a logic flow diagram which sets forth the steps for calculating spectral smoothing of the current amplitude speech estimator.

Refer now to FIG. 14. FIG. 14 illustrates the spectral smoothing algorithm. The spectral smoother method uses previous spectral power estimates $A_k(n-1), \ldots$ for each component. First, the value of the current estimator is compared to the value of the residual noise estimator generated previously. If the estimated spectral power is greater than the residual estimator, there is a high probability that speech is present at that frequency so that the smoother is not activated. If the estimated spectral value is lower, it is replaced by the minimum value $A_k(n-1), \ldots$ in the buffer which is thereafter used in reconstructing the signal. This mechanism eliminates strong variations between frames produced by noise at determined frequencies. Refer now to FIG. 2C. FIG. 2C is an embodiment of the invention wherein spectral smoothing is performed on the amplitude estimator.

The invention has now been explained with reference to specific embodiments. Other embodiments, including realizations in hardware and realizations in other preprogrammed or software forms, will be apparent to those of ordinary skill in the art. It is therefore not intended that the invention be limited except as indicated by the appended claims.

What is claimed is:

1. A digital processing method for reducing the noise in noisy speech signals, including the steps of:

(a) generating background noise estimates from noisy speech and storing said background noise estimates;

(b) generating adaptive current noise estimates from current noisy speech signals and stored background noise estimates;

(c) generating current gain estimates from adaptive current noise estimates and past speech estimates; and (d) using current gain estimates and current noisy speech to obtain current speech estimates, wherein said step of using adaptive current noise estimates and past speech estimates to obtain current gain estimates includes the step of limiting the lower limit of the gain estimate to eliminate musical noise, and wherein said step of generating adaptive current noise estimates includes employing results of a speech/no speech decision from information obtained from current signal input to distinguish said noisy speech from background noise.

2. A digital processing method according to claim 1 and wherein said step of using current gain estimates and current noisy speech to obtain current speech estimates comprise the step of applying an automatic gain control algorithm to estimated speech in order to restore the original energy envelope of the speech.

3. The digital method of claims 1 or 2 and wherein said current noise estimates are background noise estimates.

4. The invention of claim 1 further including the step of using a speech, no speech decision to select an algorithm when generating decision directed estimates.

5. A digital processing method for reducing the noise in noisy speech signal, comprising the steps of:

(a) generating amplitude estimates from noisy speech;

(b) generating residual noise estimates from said amplitude estimates by operation of a voice operated switch; and (c) generating adaptive residual noise estimates from said amplitude estimates when speech is not present; and (d) using said adaptive residual noise estimates for smoothing speech signals.

6. A method for reducing the noise in noisy signals containing speech, said method comprising the steps of:

(a) generating, from Fourier expansion coefficients of said noisy signals, background noise estimates, and storing said background noise estimates;

(b) generating thereafter, from Fourier expansion coefficients of said signals and said stored background noise estimates, adaptive current noise estimates;

(c) generating thereafter, from said adaptive current noise estimates and past speech estimates, current gain estimates; and (d) producing thereafter, from said current gain estimates and current digitized noisy signals, current speech estimates, said current speech estimates for use thereafter as past speech estimates, wherein said step (c) includes the step of limiting the lower limit of said gain estimate to eliminate musical noise, and wherein said step (b) includes applying a speech/no speech decision to said noisy signals containing speech to identify said current speech estimates with a signal segment containing speech.

7. A method for reducing noise in noisy signals containing speech, said noisy signals being divided into time invariant segments, said method including the steps of:

(a) generating, from Fourier expansion coefficients of said segments of said noisy signals, amplitude estimates;

(b) thereafter generating, from said amplitude estimates, (i) residual noise estimates from said amplitude estimates where speech is present in a current segment, and (ii) adaptive residual noise estimates where speech is not present in a current segment; and (e) smoothing said noisy signal containing speech with said adaptive residual noise estimates to suppress noise.

8. A digital processing method for reducing the noise in noisy speech signals, including the steps of:

(a) generating, from Fourier expansion coefficients of segments of said noisy speech signals as amplitude estimates;

(b) generating background noise estimates from said amplitude estimates, including employing results of a speech/no speech decision (Y/N) from information obtained from current signal input to distinguish signals containing speech from background noise;

(c) generating first signal-to-noise estimates from said background noise estimates and said amplitude estimates (a posteriori SNR);

(d) generating decision directed signal-to-noise estimates recursively from said background noise estimates updated on the basis of previous speech amplitude estimates (a priori SNR);

(e) generating current gain estimates from said first signal-to-noise estimate and said decision directed signal-to-noise estimates; and (e) using current gain estimates and current noisy speech to obtain current speech amplitude estimates.

9. The method according to claim 8 wherein said step of using current estimates further includes the step of limiting the gain estimates to gain limited estimates to eliminate musical noise.

10. The method according to claim 8 further including the steps of employing said current speech amplitude estimates using current estimates and results of a speech/no speech decision (Y/N) from information obtained from current signal input to generate a threshold signal for adaptive residual noise for obtaining smoothed amplitude estimates.

* * * * *